US006968723B2

(12) United States Patent
Akahane et al.

(10) Patent No.: US 6,968,723 B2
(45) Date of Patent: Nov. 29, 2005

(54) METHOD OF PUNCHING SMALL HOLE AND METHOD OF MANUFACTURING LIQUID EJECTION HEAD USING THE SAME

(75) Inventors: Fujio Akahane, Nagano (JP); Nagamitsu Takashima, Nagano (JP); Kazushige Hakeda, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 10/629,899

(22) Filed: Jul. 30, 2003

(65) Prior Publication Data

US 2004/0129051 A1 Jul. 8, 2004

(30) Foreign Application Priority Data

Jul. 30, 2002 (JP) ..... P2002-221996
Jul. 29, 2003 (JP) ..... P2003-203106

(51) Int. Cl.[7] ..... B21D 28/00
(52) U.S. Cl. ..... 72/334; 29/890.142
(58) Field of Search ..... 72/334, 325; 29/890.142, 29/890.143; 76/107.6

(56) References Cited

U.S. PATENT DOCUMENTS

| | | | | |
|---|---|---|---|---|
| 3,017,789 | A * | 1/1962 | Cobb | 72/334 |
| 3,141,358 | A * | 7/1964 | Burke, Jr et al. | 72/341 |
| 4,245,491 | A * | 1/1981 | Kondo et al. | 72/254 |
| 4,299,112 | A * | 11/1981 | Kondo et al. | 72/334 |
| 4,400,965 | A * | 8/1983 | Schey | 72/334 |
| 4,956,989 | A * | 9/1990 | Nakajima | 72/327 |
| 5,125,255 | A * | 6/1992 | Brown et al. | 72/334 |
| 6,499,836 | B1 * | 12/2002 | Usui et al. | 347/70 |

FOREIGN PATENT DOCUMENTS

EP 858 893 A2 * 8/1998

* cited by examiner

*Primary Examiner*—Daniel C. Crane
(74) *Attorney, Agent, or Firm*—Sughrue Mion, PLLC

(57) ABSTRACT

An upper die and a lower die are provided. An unpenetrating hole is formed at an upper face of a metal board with the upper die, so that a protrusion is formed on a lower face of the metal board at a portion corresponding to the unpenetrating hole. A flat portion is formed on the protrusion with the lower die. The unpenetrating hole is punched with the upper die while supporting the flat portion with the lower die to form the through hole.

32 Claims, 15 Drawing Sheets

METHOD OF PUNCHING SMALL HOLE AND METHOD OF MANUFACTURING LIQUID EJECTION HEAD USING THE SAME

BACKGROUND OF THE INVENTION

The present invention relates to a method of punching a circular or rectangular small hole having a diameter or a long side of not greater than about 0.5 mm at a metal board by using an upper die and a lower die. The present invention also relates to a method of manufacturing a liquid ejection head using such a punching method.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber, as disclosed in Japanese Patent Publication No. 9-99557A.

Meanwhile, according to the above-described related recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

Further, each of the pressure generating chambers needs to be bored with a communication port for communicating the pressure generating chamber and the nozzle orifice. However, the pressure generating chambers need to be aligned with a number of slender small elongated recess portions at a small pitch and with regard to the communication port, a number of small holes each having a small opening dimension need to align at bottom portions of the elongated recess portions at a small pitch. Therefore, the working is extremely difficult and the working with high accuracy is difficult to thereby pose a problem that improvement of production efficiency is difficult to achieve.

SUMMARY OF THE INVENTION

It is therefore an object of the invention to provide a punching method capable of forming a small hole by the plastic working with excellent accuracy and a method of manufacturing a liquid ejection head using such a punching method.

In order to achieve the above objects, according to the invention, there is provided a method of punching a through hole at a metal board, comprising steps of:

providing an upper die and a lower die;

forming an unpenetrating hole at an upper face of the metal board with the upper die, so that a protrusion is formed on a lower face of the metal board at a portion corresponding to the unpenetrating hole;

forming a flat portion on the protrusion with the lower die; and punching the unpenetrating hole with the upper die while supporting the flat portion with the lower die to form the through hole.

In such a configuration, since the through hole is formed by dropping the upper die to the unpenetrating hole while supporting the flat portion by the lower die, the metal board is stabilized so that the upper die can be dropped to an aimed position. Therefore, the small through hole can be worked with excellent accuracy. Further, since the upper die can accurately be dropped to the unpenetrating hole, a difference between width dimensions of the unpenetrating hole and the through hole can also be reduced, so that a size of a stepped portion produced at an inner peripheral face of the through hole can be reduced. Further, since the metal board is supported by the lower die to through the flat portion, in comparison with a case of supporting a protrusion which is not provided with the flat portion by a die, wear or damage of en edge of the die can considerably be reduced so that the lifetime of the die can considerably be prolonged.

Preferably, a bottom of the unpenetrating hole is supported by the upper die when the flat portion is formed.

With such a configuration, it is prevented a hole shape of the unpenetrating hole from being deteriorated when the flat portion is formed. Therefore, shape accuracy of the finally formed small hole is improved so that the small hole can be worked with higher accuracy.

Preferably, the upper face of the metal board is supported by the upper die when the flat portion is formed.

With such a configuration, the metal board is stabilized when the flat portion is formed so that the flat portion having a high accuracy of parallelism with the surfaces of the metal board can be formed. Accordingly, the through hole can be formed while supporting the flat portion having high parallelism accuracy is formed, so that the small hole can be worked with higher accuracy.

Preferably, the upper die comprises a first upper die which forms the unpenetrating hole and a second upper die which forms the through hole.

With such a configuration, for example, the second upper die having a width so as to provide a clearance with respect to an inner face of the unpenetrating hole can be adopted. In this case, even after working to form the flat portion is carried out, the upper die is smoothly drawn from the unpenetrating hole, seizure or the like of material to the die is prevented so that the lifetime of the die can be prolonged.

Preferably, a draft is provided on the upper die. Even in a case where a common upper die is used to save manufacturing cost, since the upper die is smoothly drawn from the unpenetrating hole, seizure or the like of the material to the die is prevented and the lifetime of the die can be prolonged.

Preferably, the lower die is configured such that the flat portion is annularly formed.

With such a configuration, in comparison with a case of working the whole of a top portion of the protrusion to be flat, an amount of working is reduced, working energy is saved so that the lifetime of apparatus or die can be prolonged. It is sufficient to ensure stability of the metal board when the through hole is formed.

Preferably, the lower die comprises a first lower die which forms the flat portion and a second lower die which supports the flat portion when the through hole is formed.

With such a configuration, since the first lower die carries out only a small amount of working to merely form the flat portion, wear or damage is reduced so that the lifetime of the die can be prolonged. Accordingly, accuracy of the flat portion can be maintained over a long time period, which is advantageous in view of process control or accuracy control.

Preferably, the upper die and the lower die are configured such that a plurality of through holes are simultaneously punched.

With such a configuration, a number of the small holes which are relatively difficult to work with high accuracy can efficiently be worked with high accuracy.

Here, it is preferable that the through holes are arranged with an interval of 0.3 mm or less.

Preferably, a maximum width dimension of the through hole is 0.2 mm or less.

Preferably, a ratio of a penetrating length of the through hole with respect to a maximum width dimension of the through hole is 0.5 or more.

Although damage of the punch is liable to be brought about in forming the small hole in such a condition, an advantage of the invention of stabilizing the metal board, making the damage of the punch difficult to be brought about and capable of prolonging the lifetime of the die is remarkable and effective.

Preferably, the through hole is formed at a portion of the metal board which has been subjected to a plastic working.

Although workability is deteriorated at the portion which has been subjected to the plastic working, an advantage of the invention of stabilizing the metal board, making the damaged punch difficult to be brought about and capable of prolonging the lifetime of the die is remarkable and effective.

Preferably, the punching method further comprises a step of removing burrs formed on the metal board. The obtained product is more suitable for a precision element.

The through hole may have a rectangular or circular cross section.

Preferably, the metal board is comprised of nickel. Since nickel is rich in ductility, the through hole which is extremely small and requires high dimensional accuracy can be formed.

According to the invention, there is also provided a method of manufacturing a liquid ejection head, comprising steps of:

providing a metal board;

subjecting the metal board to a plastic working to form a recess on a first face of the metal board;

punching a through hole communicating the recess and a second face of the metal board, by the above punching method;

attaching a metallic nozzle plate formed with a nozzle, onto the second face of the metal board, such that the nozzle is communicated with the through hole; and attaching a metallic sealing plate formed with a liquid supply hole, onto the first face of the metal board so as to seal the recess, so that pressure generated in liquid supplied to the recess via the liquid supply hole ejects a liquid droplet from the nozzle via the through hole.

With such a configuration, the through hole communicating the recess to be a pressure generating chamber and the nozzle can be worked with extremely high accuracy. Further, since plane accuracy of the inner face of the through hole can be made to be high, flow path resistance applied on the liquid drop to be ejected is reduced so that the liquid ejection head having the excellent ejection performance can be attained.

According to the invention, there is also provided a punching apparatus, comprising:

an upper die, operable to form an unpenetrating hole at an upper face of a metal board so that a protrusion is formed on a lower face of the metal board at a portion corresponding to the unpenetrating hole; and a lower die, operable to form a flat portion on the protrusion, wherein the upper die is operable to punch the unpenetrating hole while the lower die supports the flat portion to form a through hole at the metal board.

Preferably, the upper die supports a bottom of the unpenetrating hole when the flat portion is formed.

Preferably, the upper die supports the upper face of the metal board when the flat portion is formed.

Preferably, the upper die comprises a first upper die which forms the unpenetrating hole and a second upper die which forms the through hole.

Here, it is preferable that a width of the first upper die is greater than a width of the second upper die.

It is also preferable that the upper die further comprises a third upper die which supports a bottom of the unpenetrating hole when the flat portion is formed.

Here, it is preferable that a width of the third upper die is smaller than a width of the first upper die.

By using the third upper die for supporting the unpenetrating hole which is different from the first upper die and using the third upper die having a clearance from the inner face of the unpenetrating hole, even after working to form the flat portion at the second step, the third upper die is smoothly drawn from the unpenetrating hole, seizure of material to the die or the like is prevented so that the lifetime of the die can be prolonged.

Preferably, a draft is provided on the upper die.

Preferably, the lower die is configured such that the flat portion is formed annularly.

It is also preferable that: the lower die comprises a first lower die which forms the flat portion and a second die which supports the flat portion when the through hole is formed; the first lower die is formed with a first working hole which defines the flat portion, and the second lower die is formed with a second working hole which defines a portion for supporting the flat portion; and a size of the second working hole is greater than the first working hole.

With the above configuration, since the through hole can be formed a portion at which the flat portion has been formed, the occurrence of burr can be suppressed so that the after-treatment can be facilitated. Further, even when the positions of the first and second lower dies are slightly deviated, the second lower die can certainly support the flat portion.

Here, it is preferable that: the lower die further comprises a third lower die which supports the lower face of the metal board when the unpenetrating hole is formed; the third lower die is formed with a third working hole which defines a portion at which the protrusion is formed; and a size of the third working hole is greater than the size of the second working hole.

With the above configuration, the flat portion can be surely formed on the protrusion.

Preferably, the upper die and the lower die are configured such that a plurality of through holes are simultaneously punched.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1A:
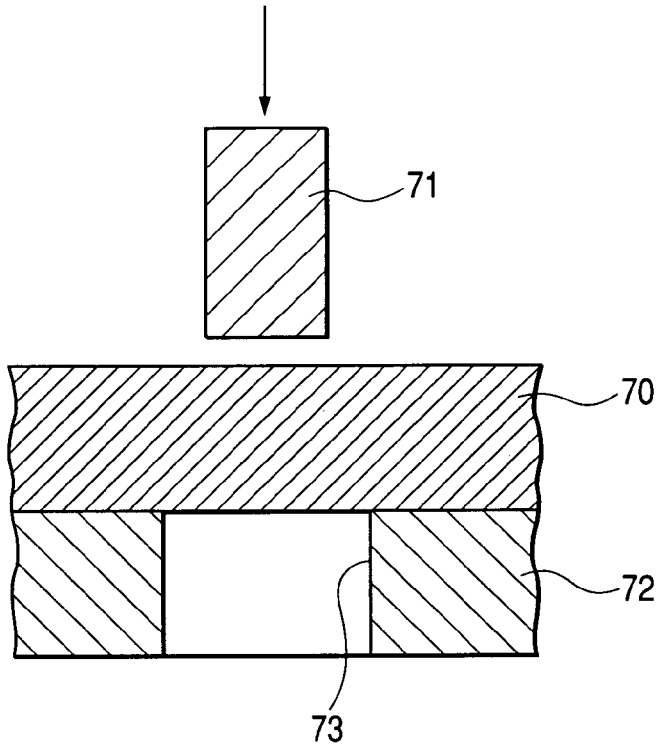
FIGS. 1A and 1B are sectional views showing a first step of a method of punching a small hole according to the invention.

Embodiments of the invention will be explained below in reference to the accompanying drawings.

According to a method of punching a small hole of the invention, a small hole is punched at a metal board 70 by using an upper die and a lower die. In the following explanation, a punch is used as an upper die, a die is used as a lower die, and an explanation will be given by defining an upper die and a lower die used in the first step respectively as a first punch 71 and a first die 72, an upper die and a lower die used in the second step respectively as a second punch 76 and a second die 77, and an upper die and a lower die used in the third step respectively as a third punch 82 and a third die 83.

Figure 1B:
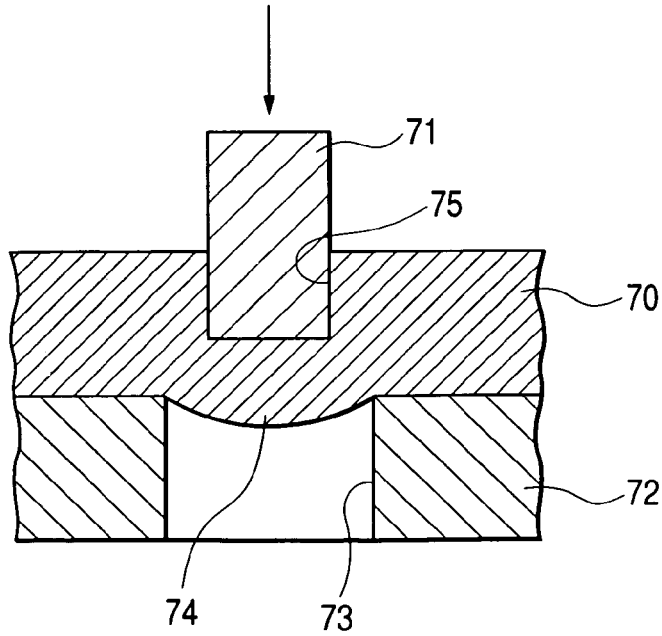
Figure 2A:
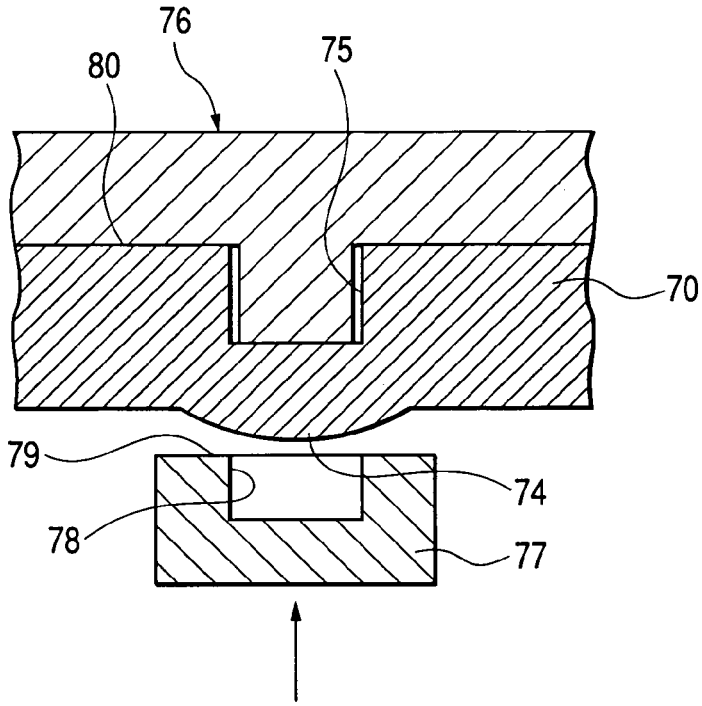
FIGS. 2A and 2B are sectional views showing a second step of the punching method.
Figure 2B:
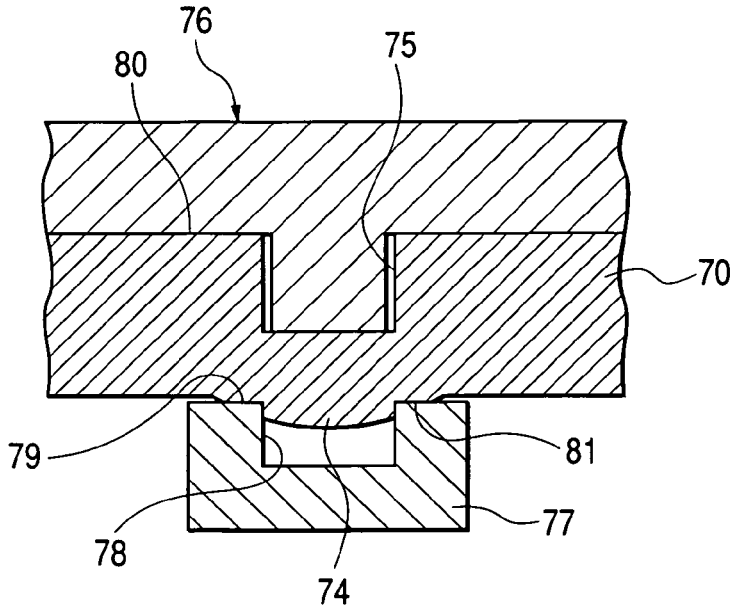
Figure 3A:
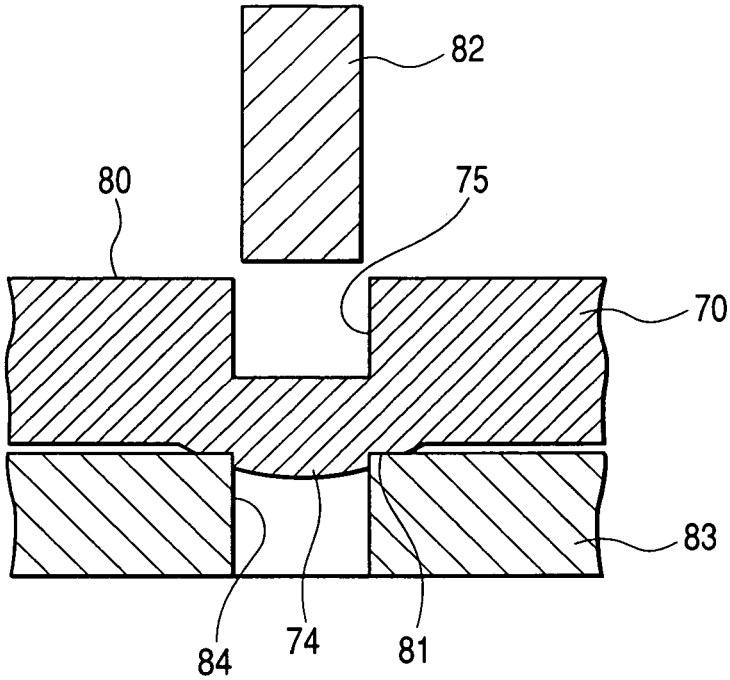
FIGS. 3A and 3B are sectional views showing a third step of the punching method.
Figure 3B:
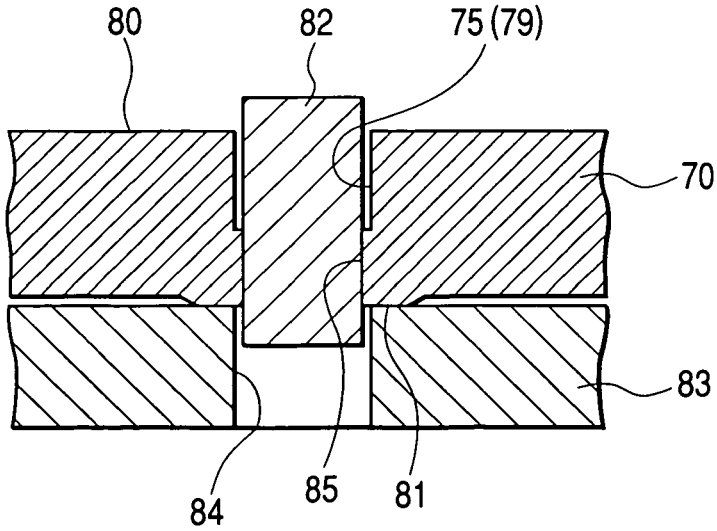

According to the method of punching the small hole, first, at the first step, an unpenetrating hole 75 is formed at the metal board 70 by the first punch 71 (FIGS. 1A and 1B). Successively, at the second step, a flat portion 81 is formed on a protrusion 74 formed at a portion of a lower side face of the metal board 70 in correspondence with the unpenetrating hole 75 by the first step (FIGS. 2A and 2B). Further, at the third step, a through hole 85 is punched by dropping the third punch 82 into the unpenetrating hole 75 while supporting the flat portion 81 by the third die 83 (FIGS. 3A and 3B). Here, working of the first step through the third step can be carried out in the same stage at a progressive die.

The working method will be explained in details as follows.

FIG. 1A shows an initial state of the first step. At the first step, the metal board 70 is mounted on an upper face of the first die 72 and the first punch 71 is arranged at a position on an upper side of the metal board 70 in correspondence with a working hole 73 of the first die 72.

An opening dimension of the working hole 73 of the first die 72 is set to be larger than an opening dimension of a working hole 84 of the third die 83 used at the third step. Further, a working dimension (end face dimension of distal end portion) of the first punch 71 is set to be smaller than the opening dimension of the working hole 73 of the first die 72 and larger than a working dimension of the third punch 82 used in the third step.

Here, the opening dimension of the working hole 73 of the die or the working dimension of the punch is a diameter dimension when a small hole in a circular shape is punched and refers to respective dimensions in a vertical direction and a horizontal direction or a dimension or a diagonal line when a small hole in a rectangular shape is punched and depending on a shape of a small hole to be punched, a suitable dimension is selected pertinently.

Further, although a metal material constituting the metal board 70 is not particularly limited but various materials can be applied therefor, nickel which is rich in ductility and capable of forming to work a small hole which is extremely small and requires high dimensional accuracy with high dimensional accuracy can preferably be used.

Further, at the first step, as shown in FIG. 1B, the first punch 71 is pushed from the initial state to a middle of a thickness of the metal board 70 to thereby form the unpenetrating hole 75 at the metal board 70. At this occasion, by plastic deformation by working the first punch 71, the protrusion 74 is formed at the portion of the lower side face of the metal board 70 in correspondence with the unpenetrating hole 75. The protrusion 74 is formed in a shape in compliance with the opening shape of the working hole 73 of the first die 72 such that a central portion thereof is projected to form a top portion.

In this way, in forming the unpenetrating hole 75 by working by the first punch 71, by using the first die 72 having the working hole 73 to form the protrusion 74 at a lower face in correspondence with the unpenetrating hole 75, in working to form the unpenetrating hole 75, a material is prevented from being raised to the upper face side of the metal board 70 and accuracy of the upper face of the metal board 70 can be ensured. Further, even when small holes aligned at a small pitch are simultaneously punched, influence on a contiguous working portion in working to form the unpenetrating hole 75 can be minimized and accuracy of a total can be ensured.

When the working at the first step has been finished, the first punch 71 is drawn from the unpenetrating hole 75 and the metal board 70 is transported to the successive second step.

FIG. 2A shows an initial state of the second step. At the second step, the second punch 76 for supporting the metal board 70 from an upper side thereof is arranged on the upper side of the metal board 70. The second punch 76 is formed with a projection in correspondence with the unpenetrating hole 75 at a lower face of a base member thereof, supports an upper face 80 of the metal board 70 by a lower face of the base member and supports the unpenetrating hole 75 by the projection.

The projection is formed in a shape substantially the same as the opening shape of the unpenetrating hole 75 and a width dimension of the projection is set to be slightly smaller than the opening dimension of the unpenetrating hole 75 such a degree as to provide a slight clearance between the projection and an inner face of the unpenetrating hole 75.

Meanwhile, a lower side of the metal board 70 is arranged with the second die 77 formed with a projection 79 having a working hole 78 at an upper face thereof. The second die 77 is positioned such that the working hole 78 and the projection 79 face the protrusion 74 at the lower face of the metal board 70. An opening dimension of the working hole 78 of the second die 77 is set to be slightly smaller than the opening dimension of the working hole 84 of the third die 83.

Further, at the second step, as shown in FIG. 2B, the second die 77 is pushed up from the initial state to press the protrusion 74 by the projection 79 to form the flat portion 81 in a ring-like shape. The ring-like flat portion 81 formed at this occasion is formed in a state in which a peripheral portion of the opening of the working hole 84 of the third die 83 used in the third step can stably be brought into contact therewith.

At this occasion, since the inner face of the unpenetrating hole 75 and the upper face 80 of the metal board 70 are supported by the second punch 76, in forming the flat portion 81 on the lower side face of the protrusion 74, the metal board 70 can be stabilized and the flat portion 81 having a high parallelism with a surface of the metal board 70 can be formed. Thereby, since the through hole 85 can be punched at the third step while supporting the flat portion 81 having the high parallelism accuracy, the small hole having a higher accuracy can be worked. Further, by working to form the flat portion 81, a hole shape of the unpenetrating hole 75 can be prevented from being deteriorated, shape accuracy of the finally formed small hole can be improved and the small hole having higher accuracy can be worked. Further, a difference between dimensions of the unpenetrating hole 75 and the third punch 82 can be reduced and working of reducing a stepped difference produced at an inner peripheral face of the small hole can also be carried out.

Further, by using the second punch 76 for supporting the unpenetrating hole 75 from the upper side at the second step which is different from the first punch 71 at the first step and using the second punch 76 having a clearance from the inner face of the unpenetrating hole 75, even after working to form the flat portion 81 at the second step, the second punch 76 is smoothly drawn from the unpenetrating hole 75, seizure of material to the die or the like is prevented so that the lifetime of the die can be prolonged.

Further, by forming the flat portion 81 in the ring-like shape by the second die 77, in comparison with a case of forming a total of the top portion of the protrusion 74 to be flat, the amount of working is reduced, working energy is saved and the lifetime of apparatus or die can be prolonged. Further, by supporting the flat portion 81, stability of the metal board 70 at the third step is ensured and the flat portion 81 is supported by the third die 83 without trouble.

When working at the second step has been finished, the second punch 76 is drawn from the unpenetrating hole 75 and the metal board 70 is transported to the successive third step.

FIG. 3A shows an initial state of the third step. At the third step, the flat portion 81 formed at the second step is positioned such that a peripheral portion of an opening of the working hole 84 of the third die 83 is brought into a contact therewith. Further, the third punch 82 is arranged at a position in correspondence with the unpenetrating hole 75.

An opening dimension of the working hole 84 of the third die 83 is formed to be a slight larger than the opening dimension of the working hole 78 of the second die 77 used in the second step. Further, a working dimension of the third punch 82 is set to be equivalent to or slightly smaller than the opening dimension of the unpenetrating hole 75.

Further, at the third step, as shown in FIG. 3B, the third punch 82 is struck to drop from the initial state to a bottom face of the unpenetrating hole 75 and the penetrated hole 85 is punched in a state of supporting the flat portion 81 from a lower side thereof by the third die 83. Thereafter, as needed, after the third step of forming the penetrated hole 85, debarring by polishing is carried out and edge back or burr produced by working by the punches and the dies is removed.

At this occasion, since the through hole 85 is formed by the third punch 82 while supporting the flat portion 81 formed at the second step from the lower side by the third die 83, the metal board 70 is stabilized in forming the through hole 85, and the third punch 82 can be dropped to an aimed position and the small hole with excellent accuracy can be worked. Further, a difference between dimensions of the unpenetrating hole 75 and the third punch 82 can be reduced, the stepped difference produced at the inner peripheral face of the penetrated hole 85 can be reduced and the small hole can be formed with higher accuracy. Further, wear of edge of the third die 83 can considerably be reduced than in supporting the protrusion 74 which is not provided with the flat place 81 by the third die 83.

Further, by making the second die 77 for a small amount of working only producing the flat portion 81 differ from the third die 83 which needs a large-amount of working of forming the through hole 85 by being operated with the third punch 82, the second die 77 carries out only the small amount of working. Therefore, wear or damage of the second die 77 is reduced so that the lifetime of the die can be prolonged. Further, since wear or damage of the second die 77 is reduced, accuracy of the flat portion. 81 can be maintained over a long time period, which is advantageous also in view of process control or accuracy control.

Such a method of punching the small hole is effective when a small hole having the small opening dimension is formed, or when a small hole having a large ratio of the thickness of the metal board 70, that is, the penetrated dimension to the opening dimension of the small hole is worked. That is, in the case of the small hole having the small opening dimension or the small hole having the large ratio of the penetrated dimension to the opening dimension, the punch becomes extremely slender, In such a condition, when the metal board 70 is unstable in punching even by a small amount, the punch is liable to break and the die is damaged. However, according to the invention, the punch is prevented from breaking since the metal board 70 is stabilized in punching.

Further, in working the above-described small hole, it is effective for preventing the punch from breaking by temporarily forming the through hole 75 and thereafter punching through the bottom face of the unpenetrating hole 75. According to the invention, since the metal board 70 is stabilized in punching through the bottom face of the unpenetrating hole 75, the punch can effectively prevented from breaking.

Further, the above-described method of punching the small hole is particularly effective when a small hole having a size equal to or smaller than 0.2 mm is formed or when a small hole with a ratio of the thickness of the metal board 70, that is, the penetrated dimension to the opening dimension of the small hole equal to or larger than 0.5 is formed. Further, the method is more effective when a small hole having the ratio equal to or larger than 0.8 is formed and is further effective when one or more of small holes are worked.

Further, although according to the above explanations, a case of punching a single small hole by a set of a punch and a die is exemplified, the invention is applicable also to a case of simultaneously punching a number of small holes aligned at a predetermined pitch by numbers of aligned punches and dies. Since the number of small holes aligned at a predetermined pitch in this way is difficult to work with high accuracy, the invention enabling to work with high accuracy is effective, particularly effective when small holes aligned with the pitch equal to or smaller than 0.3 mm are formed. The invention is more effective when the pitch is equal to or smaller than 0.25 mm and is further effective when the pitch is equal to smaller than 0.2 mm. Also in this ease, as described above, the invention is effective when a small hole having a size equal to or smaller than 0.2 mm or when a small hole having a ratio of the thickness of the metal board 70, that is, the penetrated dimension to the opening dimension of the small hole equal to or larger than 0.5 is formed.

Although according to the above-described embodiment, an explanation has been given of the case of punching a small hole to the metal board 70 in a plate-like shape, in the metal board 70, a small hole may be formed at a working portion thereof by plastic working of forging or the like. Thereby, although workability of the working portion by forging is deteriorated by work hardening and it is further difficult to enhance accuracy or the lifetime of the die in working to form the small hole, by carrying out the working in a state of forming the flat portion 81 at the protrusion 74 of the metal board 70 to support, an effect of the invention stabilizing the metal board 70, an effect of the invention of making the punch difficult to be damaged and capable of prolonging the lifetime of the die is remarkable and effective.

Further, although according to the above-described embodiment, in the second step, the second punch 76 supporting the unpenetrating hole 75 and the upper face 80 of the metal board 70 is used, the invention is not limited thereto but only the upper face 80 of the metal board may be supported or only the unpenetrating hole 75 may be supported.

Further, although according to the above-described embodiment, the second punch 76 different from the first punch 71 is used, the punch 76 of the second step common to the first punch 71 used in the first step can also be used. Thereby, a number of the dies is reduced by that amount, cost required for the die can be reduced and also a number of steps can be reduced.

In this case, it is preferable to provide a draft to the first punch 71. Thereby, even after working to form the flat portion 81 at the second step, the first punch 71 can smoothly be drawn from the unpenetrating hole 75, seizure of material to the die or the like can be prevented and the lifetime of the die can be prolonged.

Further, although according to the above-described embodiment, the second die 77 for forming the flat portion 81 at the second stop which is different from the third die 83 used in the third step is used, the second die 77 for forming the flat portion 81 at the second step which is common to the third die 83 used in the third step may be used. Thereby, the number of dies is reduced by that amount, the cost required for the die can be reduced and also the number of steps can be reduced. Further, although according to the above-described embodiment, the flat portion 81 is formed at the second step, the invention is not limited thereto but a flat portion for flattening the top portion of the protrusion 74 as a whole may be formed.

An explanation will be given of a method of manufacturing a liquid ejection head using the above punching method.

Although in the following explanation, an ink jet recording head is exemplified as a liquid ejection head, the invention is not naturally limited thereto.

Figure 4:
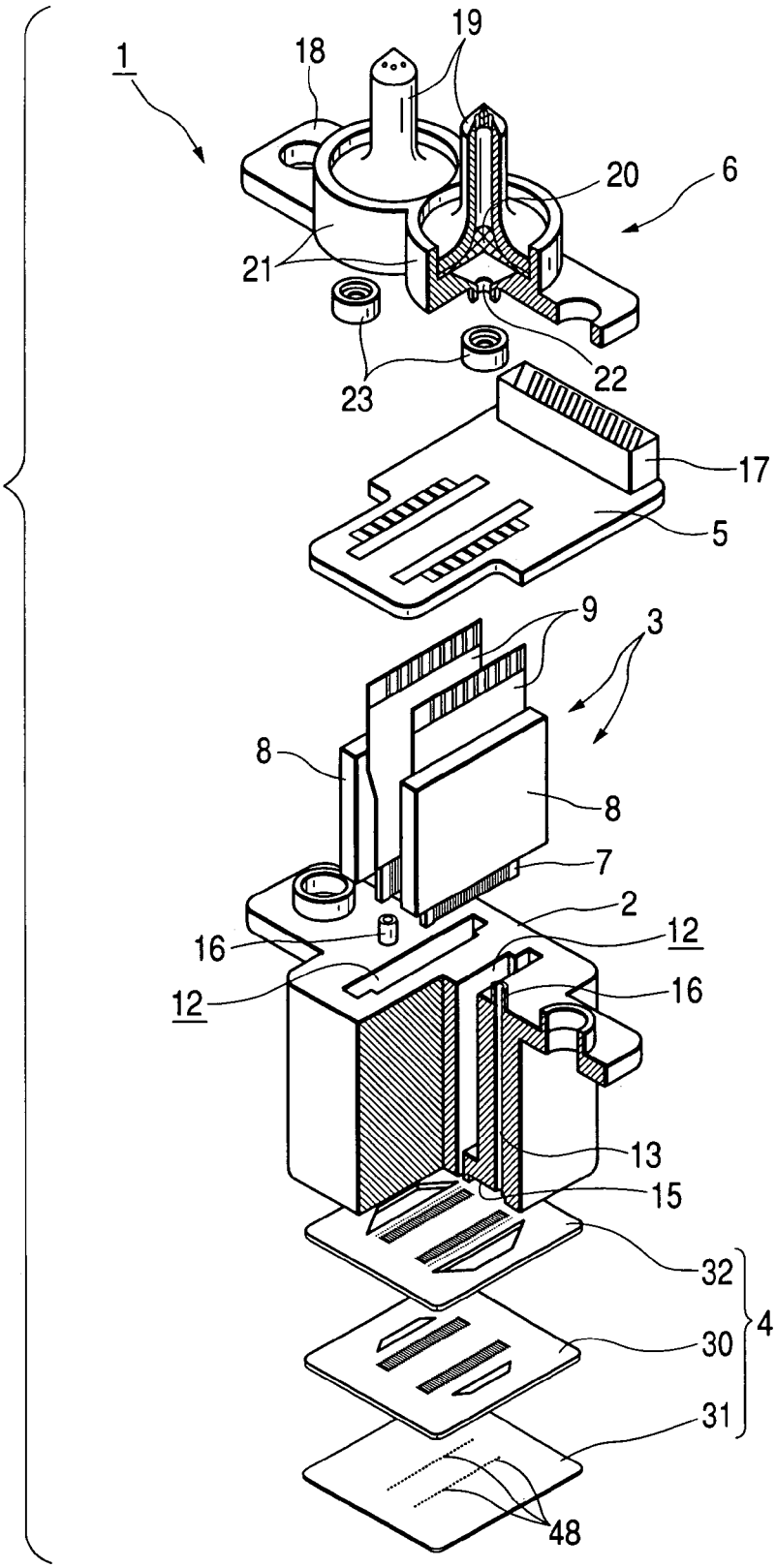
FIG. 4 is a perspective view of a disassembled ink jet recording head according to a first embodiment.
Figure 5:
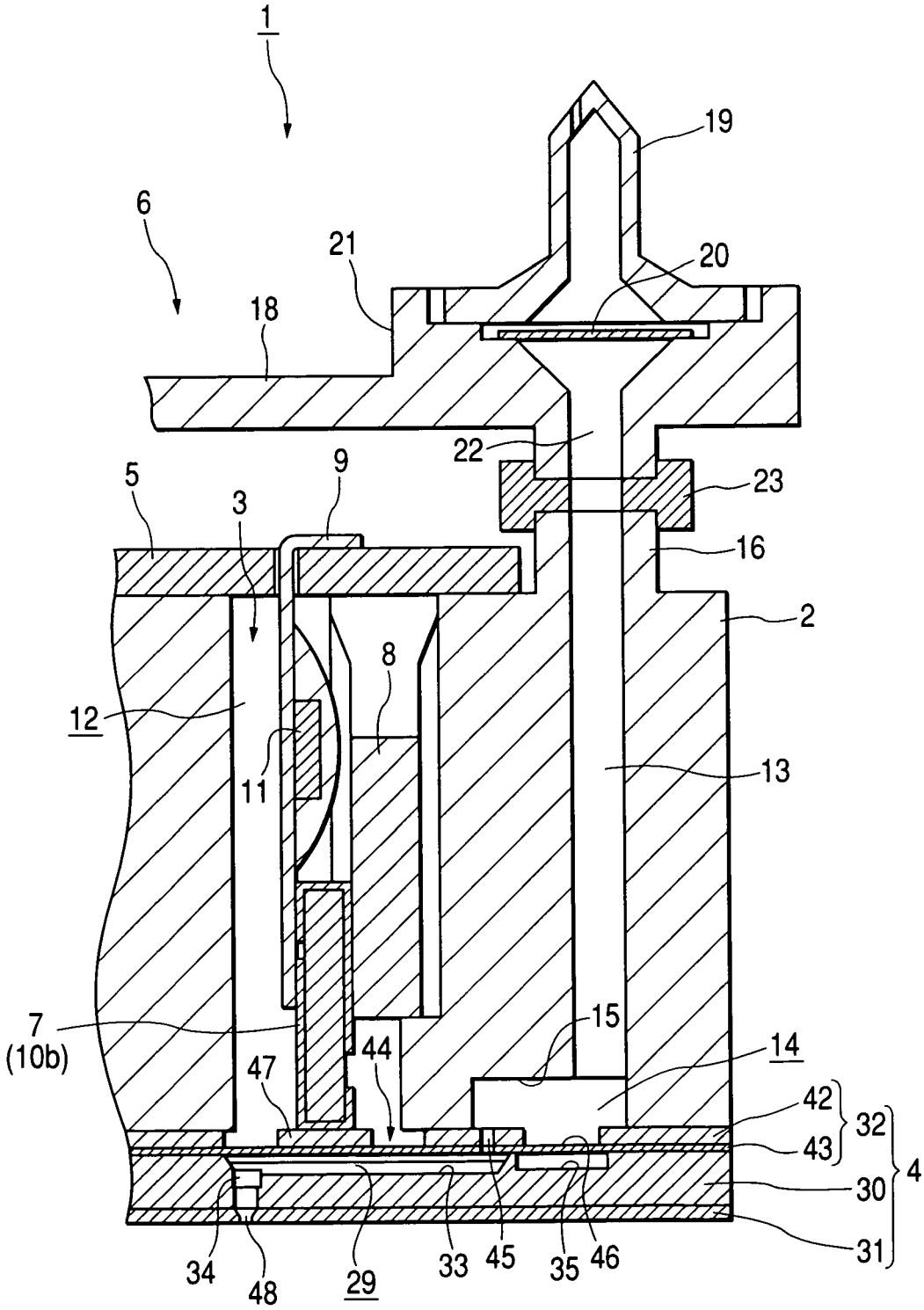
FIG. 5 is a sectional view of the ink jet recording head.

As shown in FIGS. 4 and 5, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 6A:
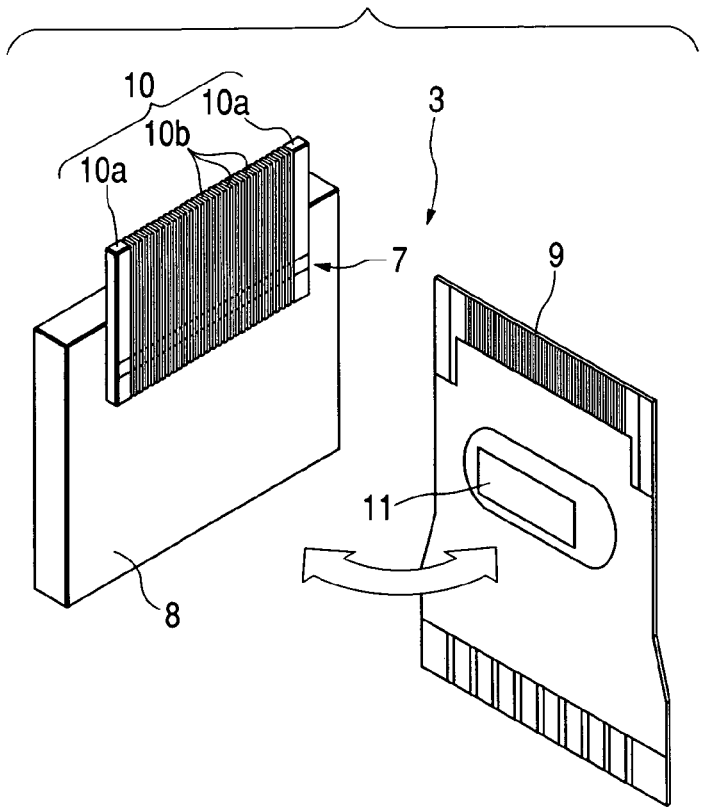
FIGS. 6A and 6B are views for explaining a vibrator unit.
Figure 6B:
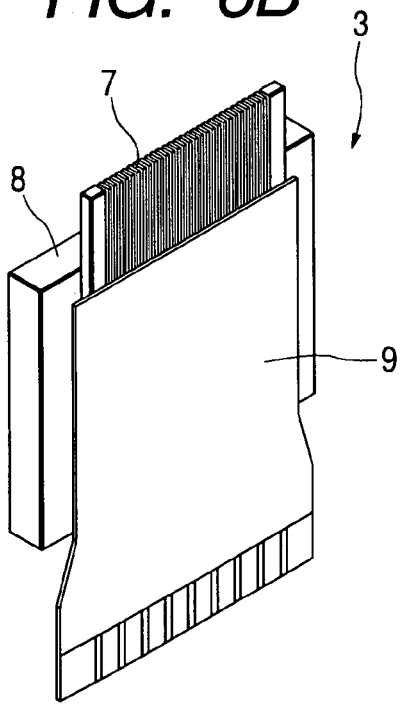

As shown in FIGS. 6A and 6B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 $\mu$m through 100 $\mu$m, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 5, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

As shown in FIG. 4, the chamber formation plate 30 is a plate-like member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 8A:
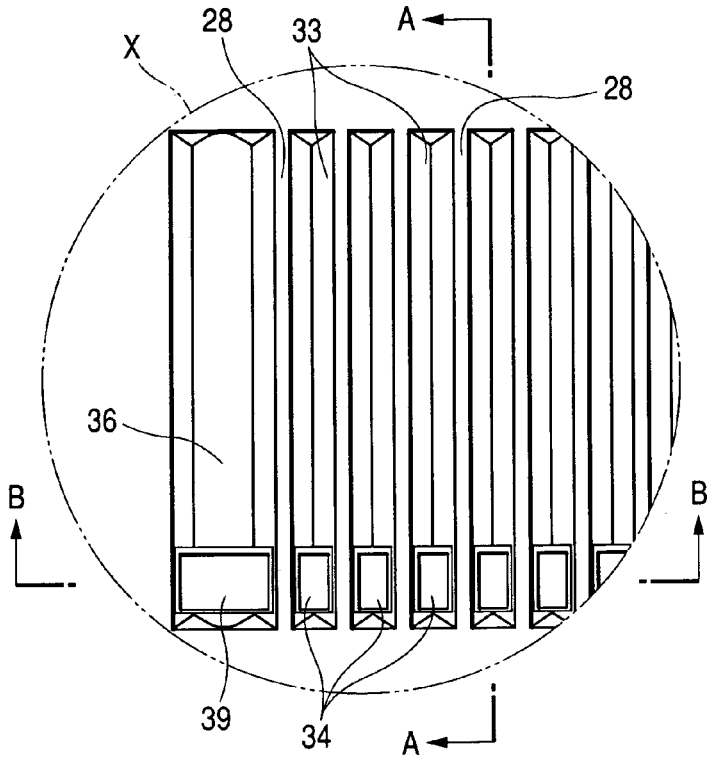
FIG. 8A is a view enlarging an X portion in FIG. 7.
Figure 8B:
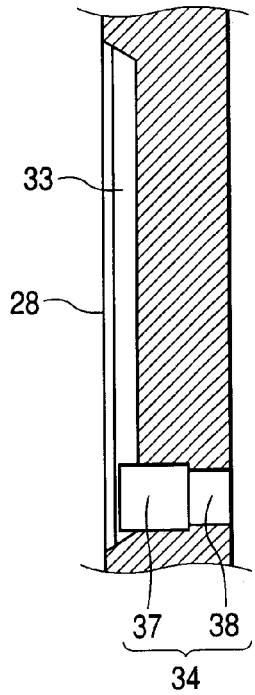
FIG. 8B is a sectional view taken along a line A—A of FIG. 8A.
Figure 8C:
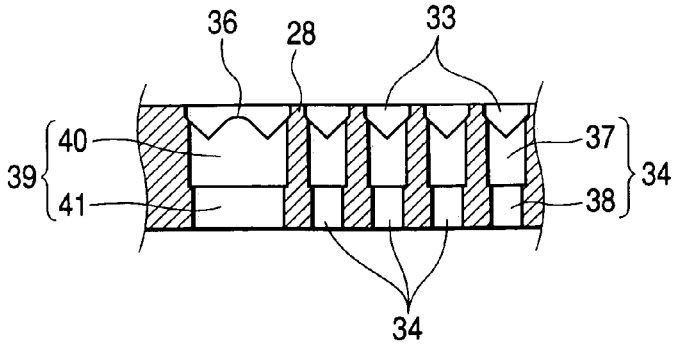
FIG. 8C is a sectional view taken along a line B—B of FIG. 8A.

The elongated recess portion 33 is a recess portion in a groove-like shape constituting a pressure generating chamber 29 and is constituted by a groove in a linear shape as shown to enlarge in FIG. 8A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33 The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Figure 7:
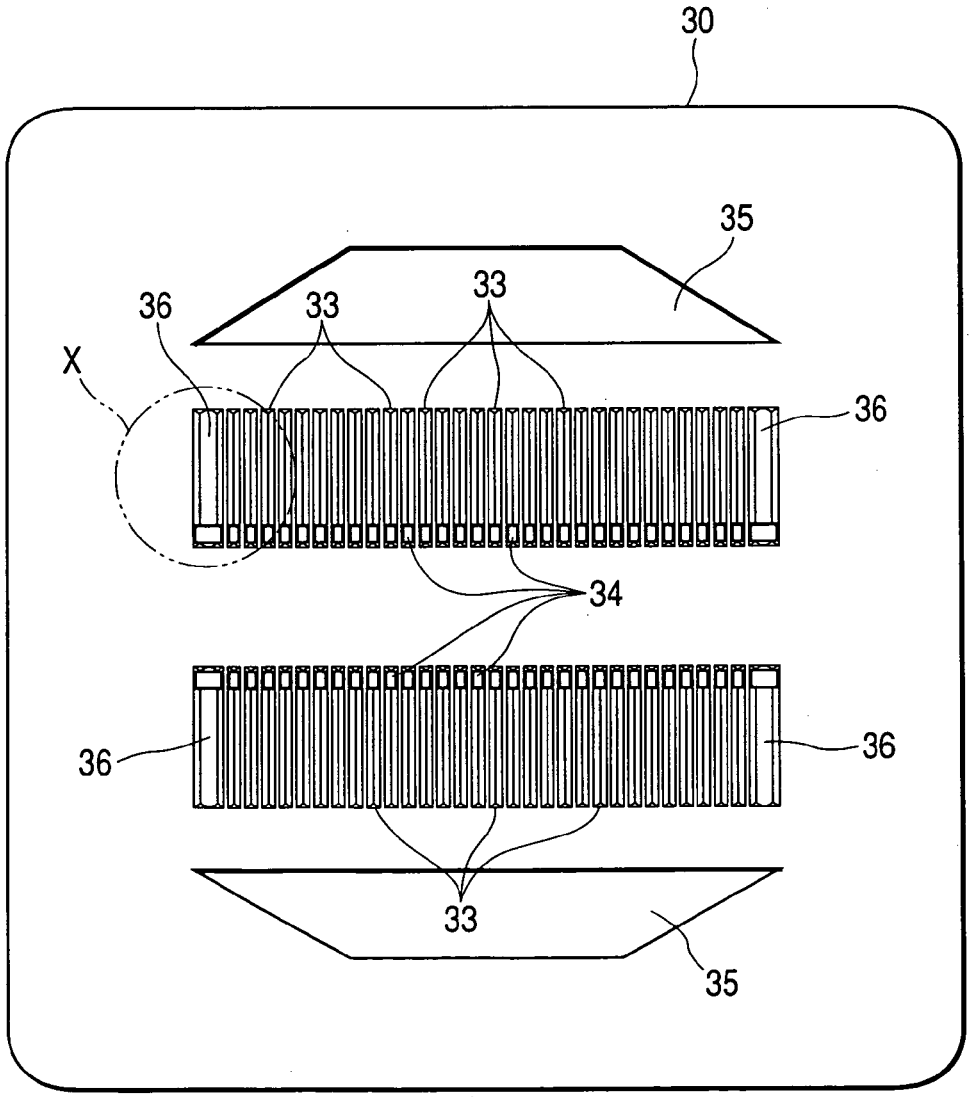
FIG. 7 is a plan view of a chamber formation plate.

Further, a row of recesses is constituted by the respective elongated recess portions 33 and the pair of dummy recess portions 38. According to the embodiment, two rows of the recesses are formed as shown in FIG. 7.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Hence, according to the invention, as described above, working is divided into three steps, at the first step, the unpenetrating hole 75 is formed at the nickel plate (corresponding to the metal board 70), at the second step, the flat portion 81 is formed by the second die 77 at the protrusion 74 formed at the portion of the lower side face of the metal board 70 in correspondence with the unpenetrating hole 75 by the first step. Further, at the third step, the penetrated hole is punched by dropping the third punch 82 to the unpenetrating hole 75 while supporting the flat portion 81 by the third die 83. Further, a detailed description will be given later of a procedure of working the communicating port 34.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 9:
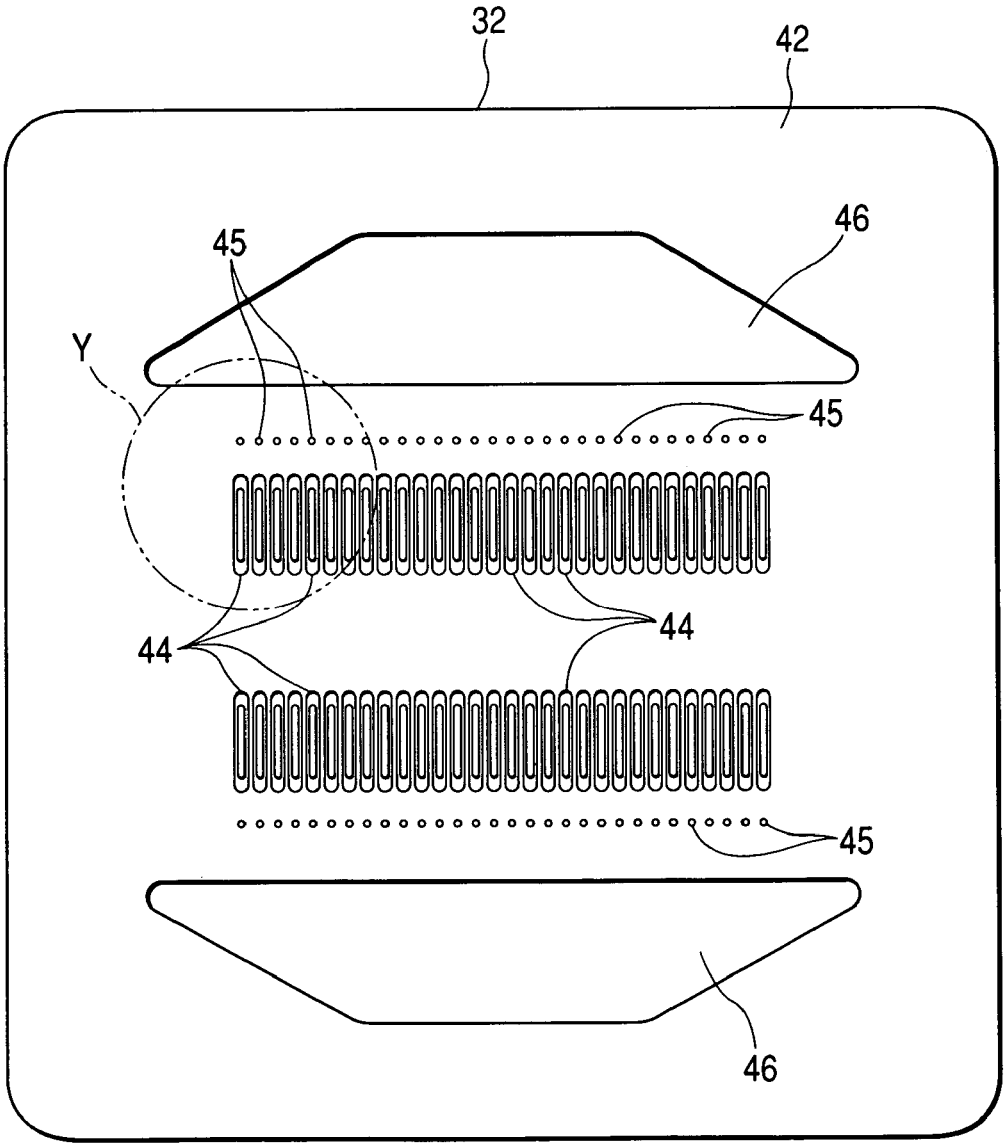
FIG. 9 is a plan view of an elastic plate.

As shown in FIG. 9, the elastic plate 32 is formed with a diaphragm portion 44, an ink supply port 45 and the compliance portion 46.

Figure 10A:
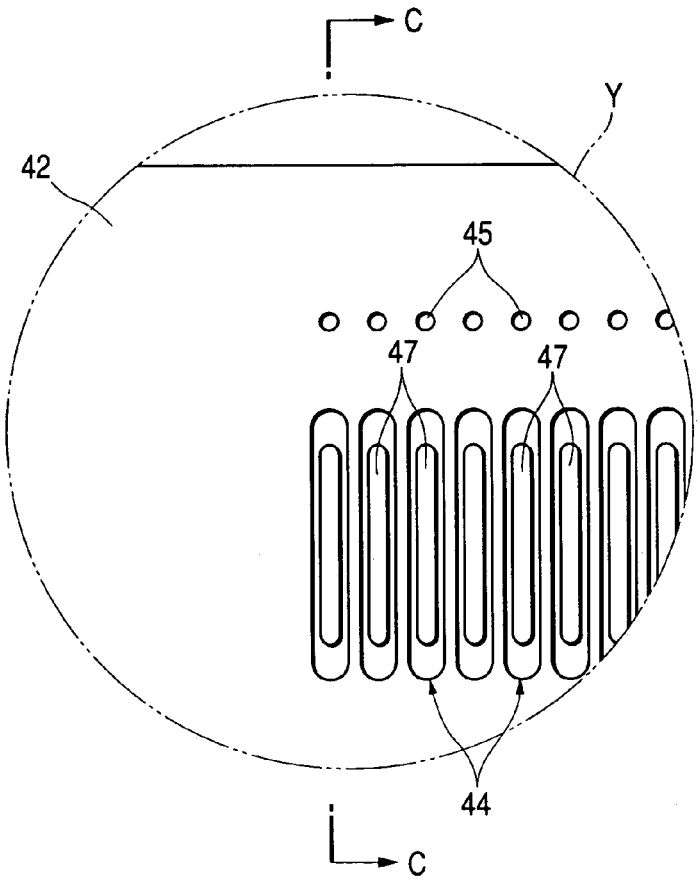
FIG. 10A is a view enlarging a Y portion of FIG. 9.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 10A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 5, one end of the diaphragm portion 44 is aligned to one end of the elongated recess portion 33 (end portion on a side of the communicating port 34).

Figure 10B:
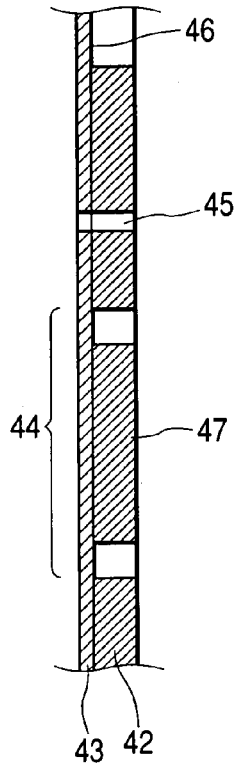
FIG. 10B is a sectional view taken along a line C—C of FIG. 10A.

As shown in FIG. 10B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 5, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 $\mu$m.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a plate-like member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink, Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion. 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a strip 55 (corresponding to the metal board 70, mentioned above) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 11A:
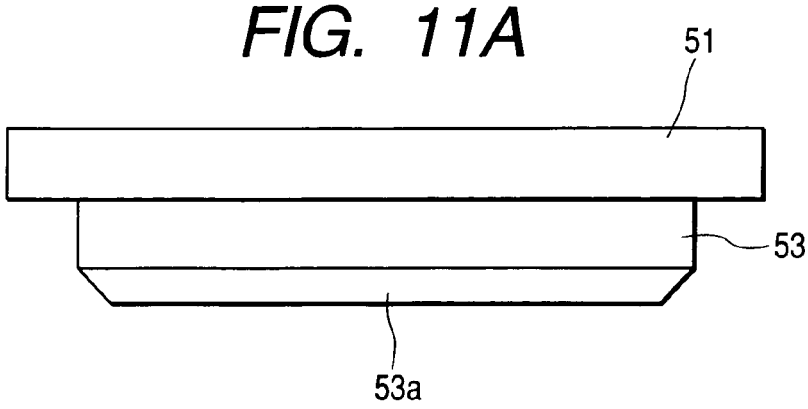
FIGS. 11A and 11B are views for explaining a first male die used in forming an elongated recess portion.
Figure 11B:
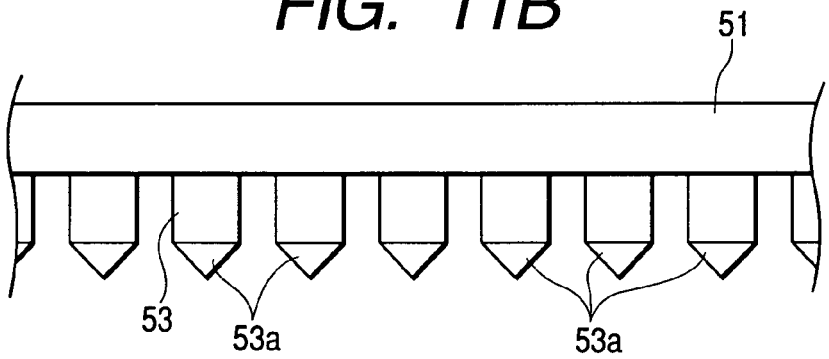
Figure 12A:
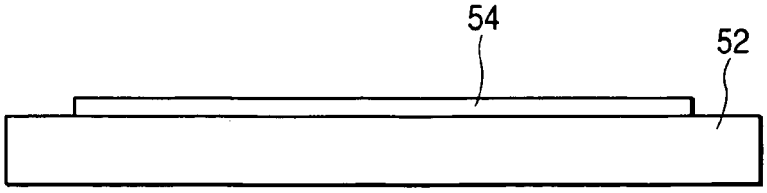
FIGS. 12A and 12B are views for explaining a female die used in forming the elongated recess portion.
Figure 12B:
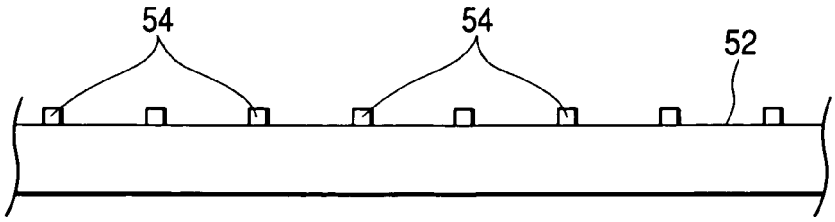

In the elongated recess portion forming steps, a first male die 51 shown in FIGS. 11A and 11B and a female die shown in FIGS. 12A and 12B are used. The first male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 38. A distal end portion 53*a* of the projection 53 is tapered from a center thereof in a width direction by an angle of about 45 degrees as shown in FIG. 11B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 11A. Therefore, the distal end portion 53*a* of the projection 53 is formed in a shape of tapering both ends of a triangular prism.

Further, the female die 52 is formed with a plurality of projections 54 at an upper face thereof The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 13A:
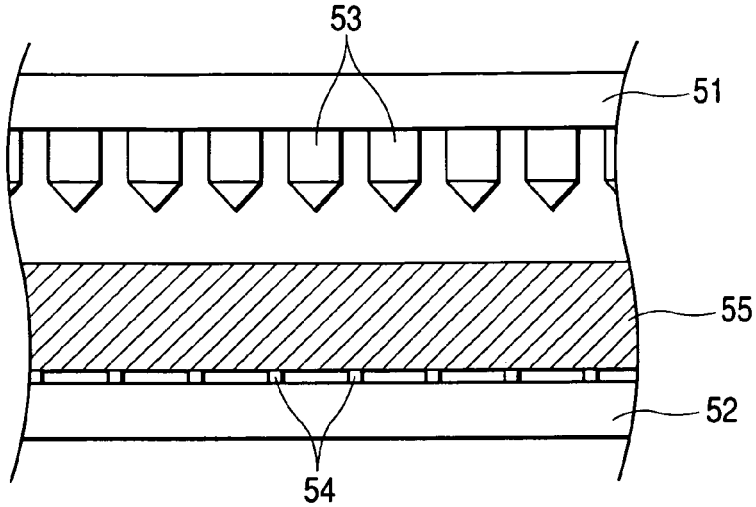
FIGS. 13A to 13C are views for explaining a step of forming the elongated recess portion.
Figure 13B:
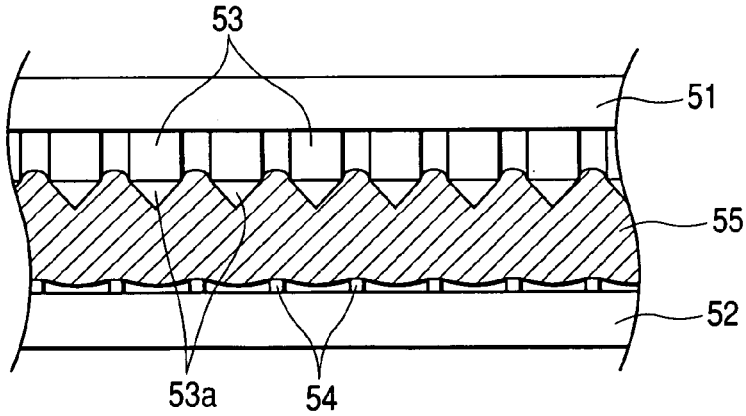
Figure 13C:
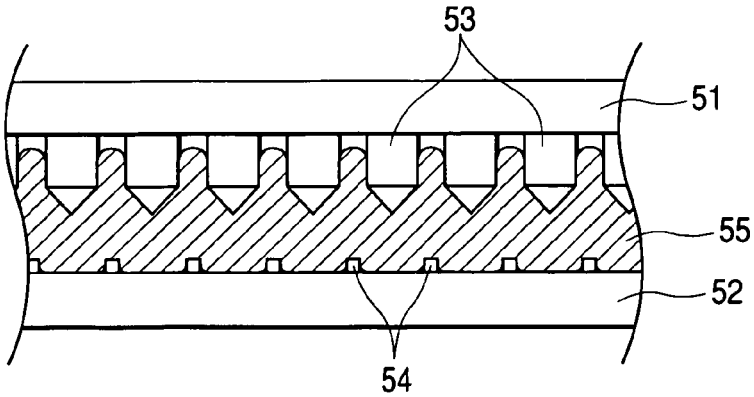

In the elongated recess portion forming steps, first, as shown in FIG. 13A, the metal strip 55 (corresponding to the above-described metal board 70, referred to as "strip 55" in the following explanation) is mounted at an upper face of the female die 52 and the first male die 51 is arranged on an upper side of the strip 55. Next, as shown in FIG. 13B; the first male die 51 is moved down to push the distal end portion of the projection 53 into the strip 55. At this occasion, since the distal end portion 53*a* of the projection 53 is sharpened in the V-like shape, the distal end portion 53*a* can firmly be pushed into the strip 55 without buckling. Pushing of the projection 53 is carried out up to a, middle in a plate thickness direction of the strip 55 as shown in FIG. 13C.

By pushing the projection 53, a portion of the strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the strip 65 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion can be formed highly.

When the elongated recess portion 33 has been formed in this way, the operation proceeds to the communicating port forming steps to form the communicating port 34 which is the small hole.

Here, the communicating port 34 is formed by applying the method of punching a small hole according to the invention. Similar to the explanation in reference to FIGS. 1A through 3B, the communicating port 34 is formed by using the first punch 71 and the first die 72 in the first step, the second punch 76 and the second die 77 in the second stop and the third punch 82 and the third die 83 in the third step.

In the communicating port forming steps, a number of the communicating ports 34 aligned at a predetermined pitch are formed, the above-described first through third punches 71, 76 and 82 which are aligned with numbers of projections at lower faces of base members are used and the above-described first through third dies 72, 77 and 83 which are aligned with number of working holes 73, 78 and 84 at upper faces thereof are used.

Figure 14A:
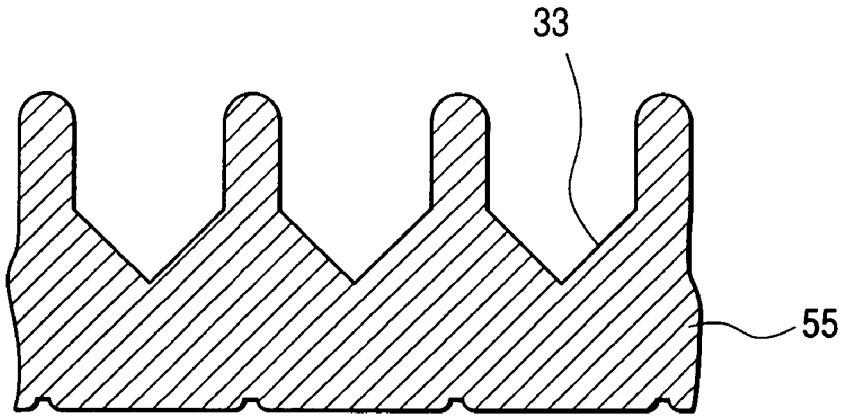
FIGS. 14A and 14B are views for explaining a first step of forming a communicating port.

FIG. 14A shows a state of the strip 55 before the communicating port forming steps, according to the example, the pitch of the elongated recess portions 33 is 0.141 mm and the communicating port 34 which is a small hole is punched at a bottom face which is a working face of each of the elongated recess portions 33 formed by forging. Further, as the communicating port 34, a small hole substantially in a rectangular shape having a longitudinal dimension of 0.16 mm and a transverse dimension of 0.095 mm is punched.

Figure 14B:
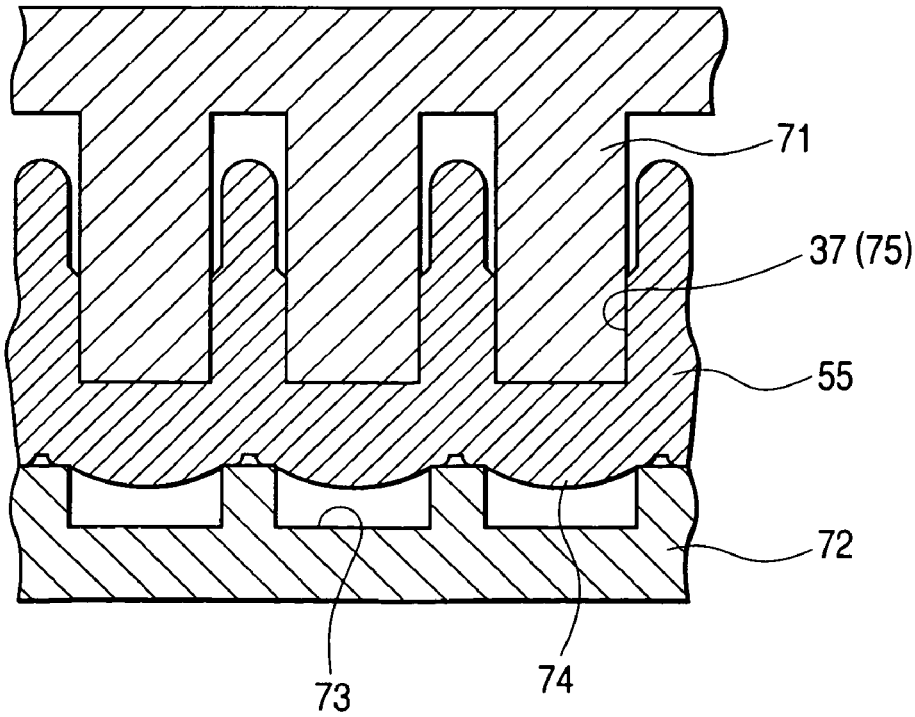

At the first step, as shown in FIG. 14B, the first punch 71 is pushed up to a middle of a thickness at a bottom portion of the elongated recess portion 33 to thereby form the unpenetrating hole 75 for constituting the first communicating port 37 at the strip 55. At this occasion, by plastic deformation by working of the first punch 71, the protrusion 74 is formed at a portion of the lower side face of the strip 55 in correspondence with the unpenetrating hole 75.

In this way, in forming the unpenetrating hole 75 by working by the first punch 71, by using the first die 72 having the working hole 73 to form the protrusion 74 at the back face in correspondence with the unpenetrating hole 75, in working at the first step, a material is prevented from raising to the upper face side of the elongated recess portion 33, that is, to the inner face of the pressure generating chamber 29 and shape accuracy of the pressure generating chamber 29 can be ensured. Further, influence on a contiguous one of the elongated recess portion 33 in working to form the unpenetrating hole 75 in the first step is minimized and accuracy of the total can be ensured.

Figure 15:
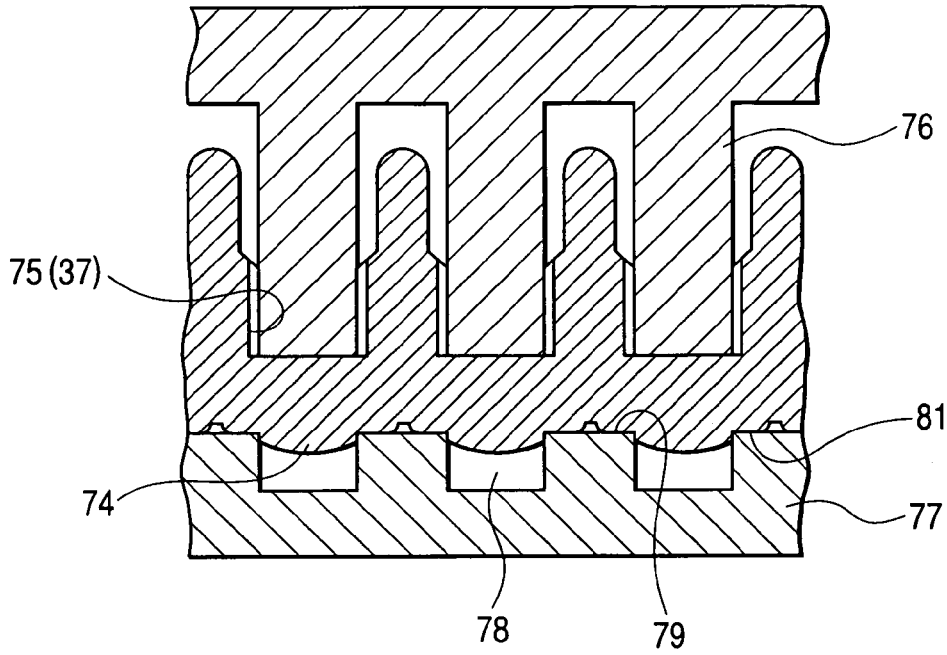
FIG. 15 is a view for explaining a second step of forming the communicating port.

Successively, at the second step, as shown in FIG. 15, the second die 77 is pushed up in a state of inserting the second punch 76 into the first communicating port 37 formed at the strip 55 to be supported thereby from the upper face side, the second die 77 is pushed up and the projection 79 is pushed to the protrusion 74 of the lower side face of the metal board 70 to form the annular flat portion 81.

Figure 16:
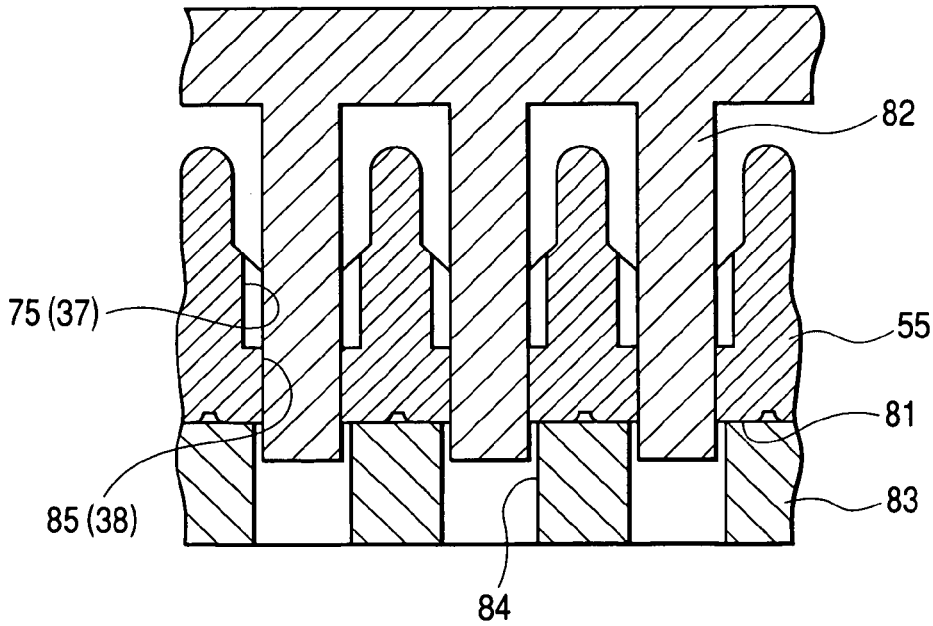
FIG. 16 is a view for explaining a third step of forming the communicating port.

In the third step, as shown in FIG. 16, a peripheral portion of an opening of the working hole 84 of the third die 83 is positioned to be brought into contact with the flat portion 81 formed at the second step and the third punch 82 is struck to drop to the bottom face of the unpenetrating hole 75 which is the first communicating port 37. Further, the through hole 85 for constituting the second communicating port 38 is punched in a state of supporting the flat portion 81 from the lower side by the third die 83.

In this way, since the communicating port 34 is formed by a plurality of times of working by using the first punch 71 and the third punch 82 having different width, even the extremely small communicating port 34 can be fabricated with excellent dimensional accuracy. Further, since the first communicating port 37 fabricated from the side of the elongated recess portion 33 is fabricated only Up to the middle in the plate thickness direction, in manufacturing the first communicating port 37, a drawback that the partition wall 28 of the pressure generating chamber 29 is excessively pulled can be prevented. Thereby, the first communicating port 37 can be fabricated with excellent dimensional accuracy without deteriorating the shape of the partition wall 28.

Further, the communicating port 34 of the chamber formation plate 30 which is a fine part can be worked with high accuracy. Since plane accuracy of the inner face of the communicating port 34 can be enhanced, also a characteristic of the liquid ejection head can be improved such that flow path resistance of a liquid to be ejected is reduced or the like. Otherwise, operation and effect similar to those of the method of punching a small hole explained in reference to FIGS. 1A through 3B are achieved.

After the communicating port 34 is fabricated, a surface of the strip 55 on the side of the elongated recess portion 33 and a surface thereof on the opposed side are polished to flatten and the plate thickness is adjusted to a predetermined thickness (0.3 mm according to the embodiment).

The elongated recess portion forming steps and the communicating port forming steps may be carried out by separate stages or carried out by the same stage. When the steps are carried out by the same stage, in the both steps, the/strip 55 remains unmoved so that the communicating port 34 can be fabricated in the elongated recess portion 33 with excellent positional accuracy. In the above-described, although the steps of manufacturing the communicating port 34 by three steps of working are exemplified, the communicating port 34 may be formed by working of four steps or more.

After the chamber formation plate 30 is fabricated by the above-described respective steps, the flow path unit 4 is fabricated by bonding the elastic plate 32 and the nozzle plate 71 which are fabricated separately to the chamber formation plate 30. According to the embodiment, bonding of the respective members is carried out by adhering. In adhering the respective members, since the surfaces of the chamber formation plate 30 are flattened by the above-described polishing step, the elastic plate 32 and the nozzle plate 31 can firmly be adhered thereto.

Further, since the elastic plate 32 is the composite material constituting the support plate 42 by the stainless steel plate, the linear expansion rate is prescribed by stainless steel constituting the support plate 42. The nozzle plate 31 is also fabricated by the stainless steel plate. As described above, since the linear expansion rate of nickel constituting the chamber formation plate 30 is substantially equal to that of stainless steel, even when adhering temperature is elevated, warping caused by the difference between the linear expansion rates is not brought about. As a result, the adhering temperature can be elevated more than in using a silicon substrate, adhering time can be shortened and fabrication efficiency is improved.

After the flow path unit 4 is fabricated, the vibrator unit 3 and the flow path unit 4 are bonded to the casing 2 fabricated separately. Also in this case, bonding of the respective members is carried out by adhering. Therefore, even when the adhering temperature is elevated, warping is not brought about in the flow path unit 4 and adhering time is shortened.

After the vibrator unit 3 and the flow path unit 4 are bonded to the casing 2, the flexible cable 9 of the vibrator unit 3 and the connection board 5 are soldered, thereafter, the supply needle unit 6 is attached thereto to thereby provide the liquid ejection head.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

With regard to the partition wall 28, when the proximal portion is more thick-walled than the distal end portion, the rigidity of the partition wall 28 can be increased while the volume necessary for the pressure related chamber 29 can be ensured. From the view point, the recess shape of the bottom face of the elongated recess portion is not limited to the V-like shape. For example, the bottom face of the elongated recess portion 33 may be recessed in an arcuate shape. Further, in order to fabricate the elongated recess portion 33 having such a bottom shape, the first male die 51 having the projection 53 the distal end portion of which is narrowed arcuately may be used.

With regard to a pressure generating element, an element other than the piezoelectric vibrator 10 may be used. For example, an electromechanical conversion element of an electrostatic actuator, a magnetostrictive element or the like may be used. Further, a heat generating element may be used as a pressure generating element.

Figure 17:
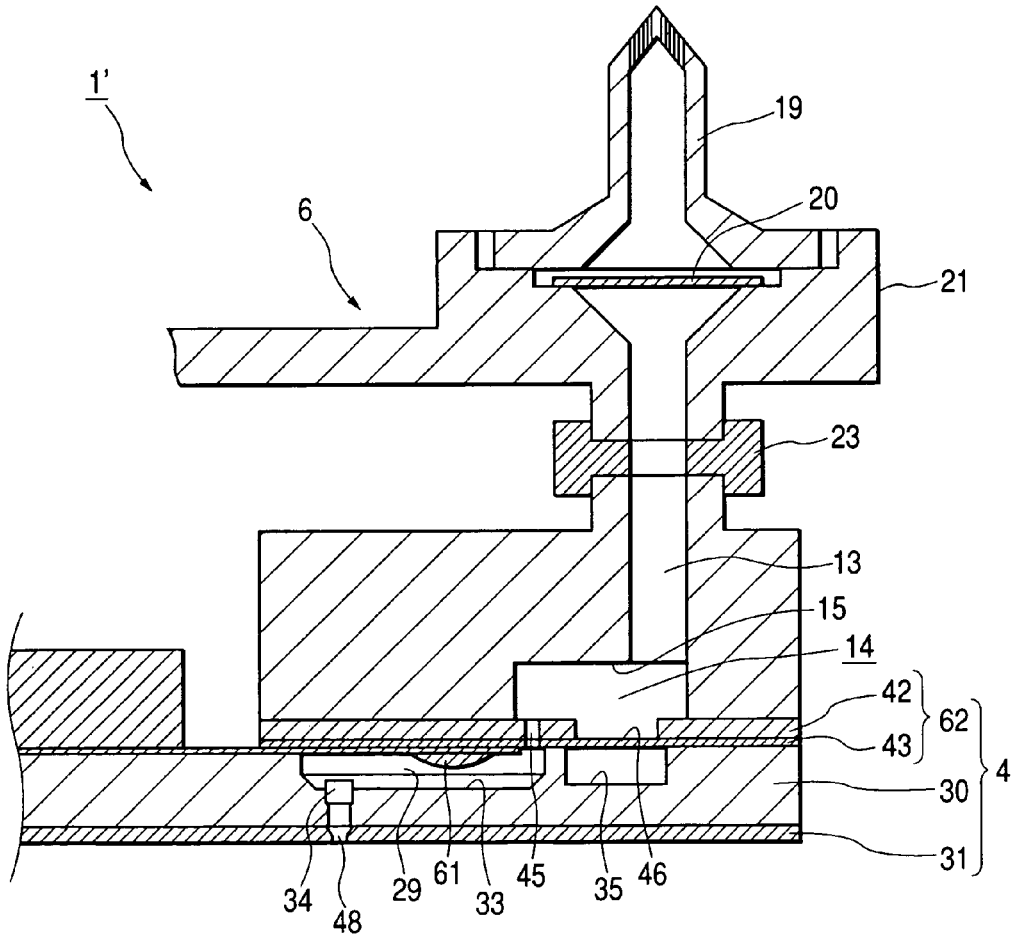
FIG. 17 is a sectional view for explaining an ink jet recording head according to a second embodiment.

As a second embodiment, a recording head 1' shown in FIG. 17 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above~described embodiments are achieved.

In the above-described embodiments, in order to achieve desired accuracy, cold working is preferably carried out for plastic deformation of forging or pressing. In order to carry out working with high accuracy, temperature control is preferably carried out such that temperature of a work falls in a constant range.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

What is claimed is:

1. A method of punching a through hole at a metal board, comprising steps of:

providing an upper die, a first lower die, a second lower die and a third lower die;

forming an unpenetrating hole at an upper face of the metal board with the upper die and the first lower die, so that a protrusion is formed on a lower face of the metal board at a portion corresponding to the unpenetrating hole;

forming a flat portion on the protrusion with the second lower die without using the first lower die; and punching the unpenetrating hole with the upper die while supporting the flat portion with the third lower die to form the through hole.

2. The punching method as set forth in claim 1, wherein a bottom of the unpenetrating hole is supported by the upper die when the flat portion is formed.

3. The punching method as set forth in claim 1, wherein the upper face of the metal board is supported by the upper die when the flat portion is formed.

4. The punching method as set forth in claim 1, wherein the upper die comprises a first upper die which forms the unpenetrating hole and a second upper die which forms the through hole.

5. The punching method as set forth in claim 1, wherein a draft is provided on the upper die.

6. The punching method as set forth in claim 1, wherein the second lower die is configured such that the flat portion is annularly formed.

7. The punching method as set forth in claim 1, wherein the upper die, the first lower die, the second lower die and the third lower die are configured such that a plurality of through holes are simultaneously punched.

8. The punching method as set forth in claim 7, wherein the through holes are arranged with an interval of 0.3 mm or less.

9. The punching method as set forth in claim 1, wherein a maximum width dimension of the through hole is 0.2 mm or less.

10. The punching method as set forth in claim 1, wherein a ratio of a penetrating length of the through hole with respect to a maximum width dimension of the through hole is 0.5 or more.

11. The punching method as set forth in claim 1, wherein the through hole is formed at a portion of the metal board which has been subjected to a plastic working.

12. The punching method as set forth in claim 1, further comprising a step of removing burrs formed on the metal board.

13. The punching method as set forth in claim 1, wherein the through hole has a rectangular cross section.

14. The punching method as set forth in claim 1, wherein the through hole has a circular cross section.

15. The punching method as set forth in claim 1, wherein the metal board is comprised of nickel.

16. The punching method as set forth in claim 1, wherein different dies are used as the second lower die and the third lower die.

17. The punching method as set forth in claim 1, wherein an identical die is used as the second lower die and the third lower die.

18. A method of manufacturing a liquid ejection head, comprising steps of:

providing a metal board;

subjecting the metal board to a plastic working to form a recess on a first face of the metal board;

providing an upper die, a first lower die, a second lower die and a third lower die;

forming an unpenetrating hole at the first face of the metal board with the upper die and the first lower die, so that a protrusion is formed on a second face of the metal board at a portion corresponding to the unpenetrating hole, the second face being opposite to the first face;

forming a flat portion on the protrusion with the second lower die;

punching the unpenetrating hole with the upper die while supporting the flat portion with the third lower die to form the through hole;

attaching a metallic nozzle plate formed with a nozzle, onto the second face of the metal board, such that the nozzle is communicated with the through hole; and attaching a metallic sealing plate formed with a liquid supply hole, onto the first face of the metal board so as to seal the recess, so that pressure generated in liquid supplied to the recess via the liquid supply hole ejects a liquid droplet from the nozzle via the through hole.

19. A punching apparatus, comprising:

an upper die and a first lower die, operable to form an unpenetrating hole at an upper face of a metal board so that a protrusion is formed on a lower face of the metal board at a portion corresponding to the unpenetrating hole;

a second lower die, operable to form a flat portion on the protrusion without the first lower die; and a third lower die, operable to support the flat portion when the upper die punches the unpenetrating hole to form a through hole at the metal board.

20. The punching apparatus as set forth in claim 19, wherein the upper die supports a bottom of the unpenetrating hole when the flat portion is formed.

21. The punching apparatus as set forth in claim 19, wherein the upper die supports the upper face of the metal board when the flat portion is formed.

22. The punching apparatus as set forth in claim 19, wherein the upper die comprises a first upper die which forms the unpenetrating hole and a second upper die which forms the through hole.

23. The punching apparatus as set forth in claim 22, wherein a width of the first upper die is greater than a width of the second upper die.

24. The punching apparatus as set forth in claim 22, wherein the upper die further comprises a third upper die which supports a bottom of the unpenetrating hole when the flat portion is formed.

25. The punching apparatus as set forth in claim 24, wherein a width of the third upper die is smaller than a width of the first upper die.

26. The punching apparatus as set forth in claim 19, wherein a draft is provided on the upper die.

27. The punching apparatus as set forth in claim 19, wherein the second lower die is configured such that the flat portion is formed annularly.

28. The punching apparatus as set forth in claim 19, wherein:

the second lower die is formed with a first working hole which defines the flat portion, and the third lower die is formed with a second working hole which defines a portion for supporting the flat portion; and a size of the second working hole is greater than the first working hole.

29. The punching apparatus as set forth in claim 28, wherein:

the first lower die is formed with a third working hole which defines a portion at which the protrusion is formed; and a size of the third working hole is greater than the size of the second working hole.

30. The punching apparatus as set forth in claim 19, wherein the upper die, the first lower die, the second lower die and the third lower die are configured such that a plurality of through holes are simultaneously punched.

31. The punching apparatus as set forth in claim 19, wherein an identical die is used as the second lower die and the third lower die.

32. A method of manufacturing a liquid ejection head, comprising steps of:

providing a metal board;

subjecting the metal board to a plastic working to form a recess on a first face of the metal board;

punching a through hole communicating the recess and a second face of the metal board;

attaching a metallic nozzle plate formed with a nozzle, onto the second face of the metal board, such that the nozzle is communicated with the through hole; and attaching a metallic sealing plate formed with a liquid supply hole, onto the first face of the metal board so as to seal the recess, so that pressure generated in liquid supplied to the recess via the liquid supply hole ejects a liquid droplet from the nozzle via the through hole.

* * * * *